US008652395B2

(12) United States Patent
Goedert et al.

(10) Patent No.: US 8,652,395 B2
(45) Date of Patent: Feb. 18, 2014

(54) METHOD FOR FEEDING PULVERISED COAL INTO A BLAST FURNACE

(75) Inventors: Paul Goedert, Mondorf-les-Bains (LU); Christian Lunkes, Soleuvre (LU); Pol Lemmer, Moersdorf (LU)

(73) Assignee: Paul Wurth S.A., Luxembourg (LU)

( * ) Notice: Subject to any disclaimer, the term of this patent is extended or adjusted under 35 U.S.C. 154(b) by 273 days.

(21) Appl. No.: 12/993,225

(22) PCT Filed: May 22, 2009

(86) PCT No.: PCT/EP2009/056211
§ 371 (c)(1),
(2), (4) Date: Apr. 5, 2011

(87) PCT Pub. No.: WO2009/141419
PCT Pub. Date: Nov. 26, 2009

(65) Prior Publication Data

US 2011/0180978 A1 Jul. 28, 2011

(30) Foreign Application Priority Data

May 23, 2008 (LU) ..... 91445

(51) Int. Cl.
*C21B 7/16* (2006.01)

(52) U.S. Cl.
USPC ..... 266/47; 266/265; 266/87

(58) Field of Classification Search
USPC ..... 266/47, 78, 87, 89, 265
See application file for complete search history.

(56) References Cited

U.S. PATENT DOCUMENTS 4,368,678 A 1/1983 Ulveling
5,397,108 A 3/1995 Alexander et al.
(Continued)

FOREIGN PATENT DOCUMENTS

EP 1060272 12/2003
JP 51-010168 6/1975
(Continued)

OTHER PUBLICATIONS

Makienko V G et al: "Monitoring and Regulating the Thermal Regime of the Tuyere Regions in a Blast Furnace" Metallurgist, Consultants Bureau. New York, US, vol. 42, No. 3/04, Mar. 1, 1998, pp. 136-139, XP000785137.
(Continued)

*Primary Examiner* — Scott Kastler
(74) *Attorney, Agent, or Firm* — Cantor Colburn LLP

(57) ABSTRACT

The present invention proposes a method for feeding pulverised coal into a blast furnace, wherein the method comprises the following steps: providing a tuyere stock (14) for blowing hot blast air from a bustle pipe (12) into a furnace hearth of a blast furnace through a tuyere (15) in an opening in the furnace wall (16); providing a pulverised coal injection lance (18) for feeding pulverised coal into the tuyere (15), the pulverised coal injection lance (18) comprising an inner pipe (20) for conveying pulverised coal and an outer pipe (22), coaxially arranged around the inner pipe (20), for conveying combustive gas, the inner pipe (20) forming a separation wall for separating the pulverised coal from the combustive gas, the pulverised coal injection lance (18) having a lance tip (24) arranged in the tuyere (15); allowing the pulverised coal and the combustive gas to form a mixture of pulverised coal and combustive gas at the lance tip (24); burning the mixture of pulverised coal and combustive gas in the tuyere (15); monitoring whether or not a flame at the lance tip (24) is burning; and upon determination that the flame at the lance tip (24) is not burning, reigniting the flame by temporarily reducing the flow of combustive gas through the pulverised coal injection lance (18).

14 Claims, 1 Drawing Sheet

(56) References Cited

U.S. PATENT DOCUMENTS

| | | | | |
|---|---|---|---|---|
| 5,481,247 | A | 1/1996 | Alexander et al. | |
| 6,059,562 | A * | 5/2000 | Anderson, II | 431/80 |
| 6,080,223 | A | 6/2000 | Mavronis | |

FOREIGN PATENT DOCUMENTS

| | | | |
|---|---|---|---|
| JP | 60125307 | | 7/1985 |
| JP | 2213406 | A | 8/1990 |
| JP | 02263907 | | 10/1990 |
| JP | 4202708 | A | 7/1992 |
| JP | 6002020 | A | 1/1994 |
| JP | 11343511 | A | 12/1999 |
| JP | 2000226609 | A | 8/2000 |
| JP | 2001181715 | A | 7/2001 |
| JP | 2002522639 | A | 7/2002 |
| JP | 2006183114 | | 7/2006 |

OTHER PUBLICATIONS

International Search Report; PCT/EP2009/056211; Aug. 28, 2009.

Japanese Office Action, Patent Application No. P2011-509992, dated May 8, 2013, with English Translation.

* cited by examiner

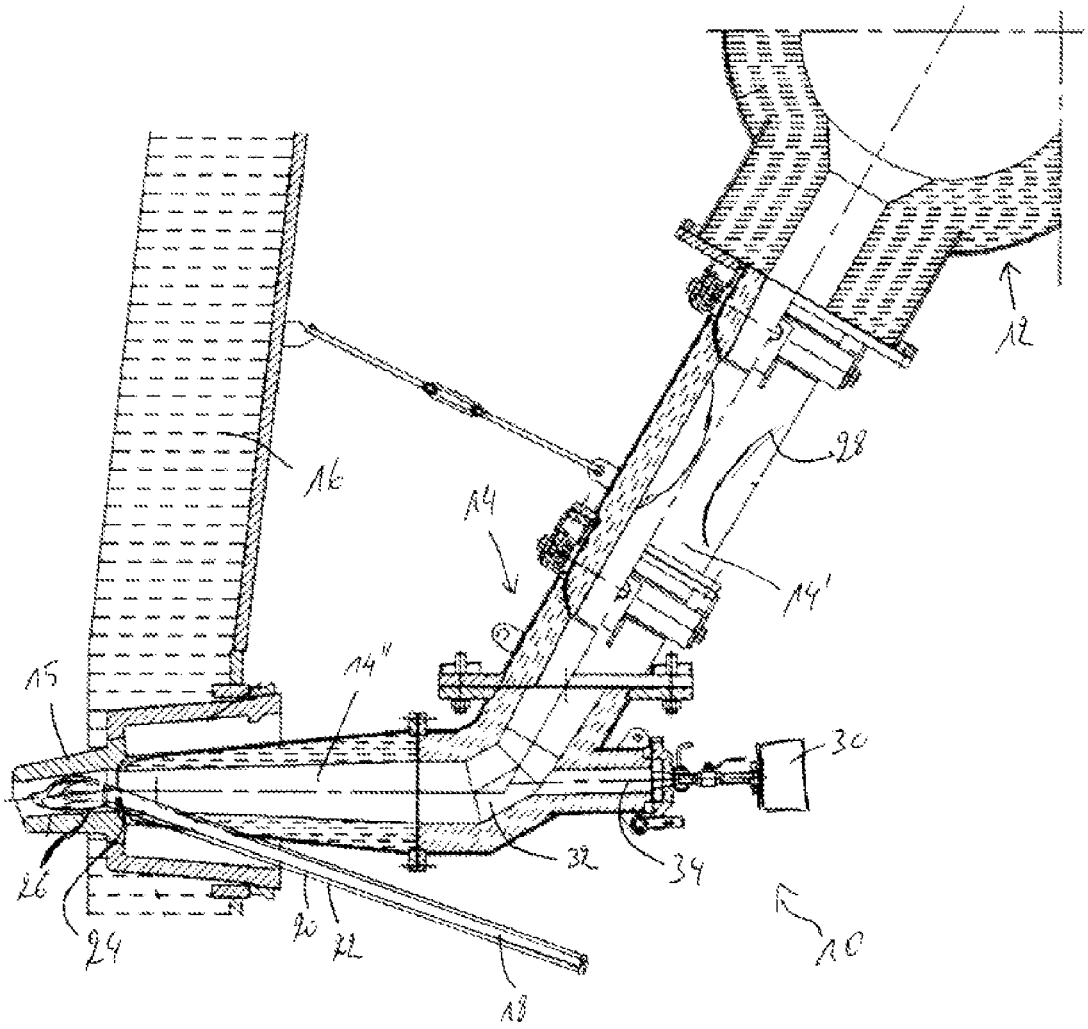
12
28
14'
14
16
14"
15
30
26
32
34
24
20
22
10
18

METHOD FOR FEEDING PULVERISED COAL INTO A BLAST FURNACE

TECHNICAL FIELD

The present invention relates to a method for feeding pulverised coal into a blast furnace, in particular through a pulverised coal injection lance having an inner pipe for conveying pulverised coal and an outer pipe, concentric to the inner pipe, for conveying combustive gas.

BACKGROUND

Pulverised coal injection lances are generally used to inject pulverised coal as a substitute to coke into a blast furnace. The pulverised coal is conveyed pneumatically through the lance and fed into an oxidising atmosphere in a tuyere, through which hot blast air is blown into the furnace. In order to completely burn the pulverised coal, the combustion reaction should begin as close to the lance tip as possible. So-called Oxycoal lances consist of an inner pipe for conveying the pulverised coal and an outer pipe, concentric to the inner pipe, for conveying combustive gas, generally pure oxygen. The presence of pure oxygen at the lance tip improves the combustion conditions so that the combustion reaction starts at the lance tip.

It has been found, however, that the flame at the lance tip is not stable and does sporadically go out. In some cases, the flame can automatically reignite without intervention. This can however not be guaranteed. If the combustion of the pulverised coal does not take place at the lance tip because the flame has extinguished, the pulverised coal and the oxygen are fed into the blast furnace, and complete burning of the pulverised coal cannot be guaranteed.

A number of solutions have been proposed in order to improve the burning efficiency at the lance tip, generally by improving the mixing of the pulverised coal and oxygen. For example, EP 1 060 272 describes that the burning of the pulverised coal can be improved and the flame maintained by providing a flow swirler between the coaxial pipes so as to impart a swirling motion to the oxygen fed to the lance tip. The effect of the flow swirler however depends very much on the structure of the lance. If the spiral angle is too deep, the oxygen is directed away from the pulverised coal and the burning efficiency is decreased. If the spiral angle is too shallow, the improvement of the burning efficiency is negligible.

It has also been suggested in EP 1 060 272, to provide the outer surface wall of the inner pipe with a plurality of dimples near the lance tip for reducing fluid flow resistance and for improving the mixing of the pulverised coal with the oxygen at the lance tip.

Although the above systems may, in certain conditions, be suitable for improving the burning efficiency, this effect is not guaranteed and there remains a risk that the flame is not maintained.

BRIEF SUMMARY

The invention provides an improved method for feeding pulverised coal into a blast furnace.

More particularly, the present invention proposes a method for feeding pulverised coal into a blast furnace, wherein the method comprises the following steps:

providing a tuyere stock for blowing hot blast air from a bustle pipe into a furnace hearth of a blast furnace through a tuyere in an opening in the furnace wall;

providing a pulverised coal injection lance for feeding pulverised coal into the tuyere, the pulverised coal injection lance comprising an inner pipe for conveying pulverised coal and an outer pipe, coaxially arranged around the inner pipe, for conveying combustive gas, the inner pipe forming a separation wall for separating the pulverised coal from the combustive gas, the pulverised coal injection lance having a lance tip arranged in the tuyere;

allowing the pulverised coal and the combustive gas to form a mixture of pulverised coal and combustive gas at the lance tip; and burning the mixture of pulverised coal and combustive gas in the tuyere.

According to an important aspect of the invention, the method comprises the further steps of:

monitoring whether or not a flame at the lance tip is burning; and upon determination that the flame at the lance tip is not burning, reigniting the flame by temporarily reducing the flow of combustive gas through the pulverised coal injection lance.

The burning of the flame is monitored and as soon as the flame extinguishes, the flow of combustive gas to the lance tip is reduced. The inventors have found that a short reduction or interruption of the supply of combustive gas allows reigniting the flame at the lance tip so that improved combustion of the pulverised coal in the tuyere can be quickly restored.

Preferably, while the flow of combustive gas through the pulverised coal injection lance is temporarily reduced, the flow of pulverised coal through the pulverised coal injection lance is maintained.

The monitoring the burning of a flame at the lance tip is preferably carried out continuously. The flame can therefore be reignited as soon as possible, so as to minimise the amount of unburnt pulverised coal being injected into the blast furnace.

The monitoring the burning of a flame at the lance tip is advantageously carried out by tuyere blockage detection means. The use of such tuyere blockage detection means allows carrying out the monitoring of the flame by devices that are already installed on blast furnaces. Because no additional detectors are necessary, no additional installation and maintenance costs need be budgeted for.

According to a first embodiment of the invention, the method comprises:

providing tuyere blockage detection means with pressure sensors for measuring a pressure drop in the hot blast air across a section of tuyere stock upstream of the lance tip; and monitoring the pressure drop across the section of tuyere stock and, based thereon, determine whether or not the flame at the lance tip is burning.

The use of means for measuring a pressure drop in the tuyere stock is currently used to detect a blockage of the tuyere. Indeed, it is possible that the exit of the tuyere into the blast furnace becomes blocked. If this occurs and further pulverised coal is injected into the tuyere, the tuyere stock fills up with pulverised coal. As soon as a blockage of the tuyere is detected, represented by a sudden reduction in pressure drop, the injection of pulverised coal and combustive gas is therefore stopped to prevent the tuyere stock and bustle pipe from filling up with pulverised coal.

The inventors have noted that the pressure drop is also influenced by the combustion reaction at the lance tip. When a flame is burning at the lance tip, heat is generated in the tuyere, such that expansion of the hot blast, which is due to the temperature increase, leads to a higher pressure drop at the tuyere. This slightly reduces the flow rate of hot blast and therefore the pressure drop in the downcomer of the tuyere stock.

A sudden increase in pressure drop can thus be interpreted as an indication that the flame at the lance tip is no longer burning.

The means for measuring a pressure drop, typically used for detecting a tuyere blockage, can be used to monitor the burning of a flame at the lance tip.

The pressure drop can be measured between the bustle pipe and a section of tuyere stock upstream of the lance tip. Pressure drop measurement means can e.g. comprise a pressure detector arranged in the section of tuyere stock upstream of the lance tip. Additionally, a Venturi tube may be arranged in the section of tuyere stock upstream of the lance tip and be associated with the pressure detector.

A signal based on the measured pressure drop can be used in a signal processing algorithm to determine whether or not the flame at the lance tip is burning.

It may e.g. be concluded that the flame at the lance tip is not burning if the pressure drop is increased by a predetermined amount. It may also be concluded that the flame at the lance tip is not burning if the pressure drop is increased by a predetermined amount for a predetermined amount of time. As the pressure drop is influenced by many parameters, the pressure drop signal has many variations, even in normal operating conditions. It is therefore preferred to conclude that the flame is not burning only if the pressure drop has increased by a certain amount or increased for a certain period or both.

According to a second embodiment of the invention, the method comprises:

providing the tuyere stock with a substantially horizontal blow pipe for blowing hot blast air into the furnace hearth of the blast furnace;

providing tuyere blockage detection means with a light intensity detector arranged in axial alignment with the blow pipe; and monitoring the light intensity in the tuyere and, based thereon, determine whether or not the flame at the lance tip is burning.

The use of means for measuring light intensity in the tuyere is currently used to detect a blockage of the tuyere. In case an important reduction of light intensity from the tuyere is detected, the tuyere is likely to be blocked and the injection of pulverised coal and combustive gas is therefore stopped to prevent the tuyere stock and bustle pipe from filling up with pulverised coal.

A reduction in light intensity can also be interpreted as an indication that the flame at the lance tip is no longer burning. Indeed, the presence of a flame in the tuyere creates light in the tuyere. The absence of a flame therefore leads to a reduced light intensity in the tuyere.

The means for measuring light intensity, typically used for detecting a tuyere blockage, can be used to monitor the burning of a flame at the lance tip.

It may be concluded that the flame at the lance tip is not burning if the light intensity in the tuyere is reduced by a predetermined amount.

It may be concluded that the flame at the lance tip is not burning if the light intensity in the tuyere is reduced by a predetermined amount for a predetermined amount of time.

According to a third embodiment of the invention, the method comprises:

providing the tuyere stock with a substantially horizontal blow pipe for blowing hot blast air into the furnace hearth of the blast furnace;

providing tuyere blockage detection means with a camera arranged in axial alignment with the blow pipe; and monitoring an image in the tuyere and, based thereon, determine whether or not the flame at the tip of the pulverised coal injection lance is burning.

The use of means for monitoring an image from the tuyere is currently used to detect a blockage of the tuyere. In case the tuyere is blocked, the characteristics of the image from the tuyere changes and, depending on the changed characteristics, the injection of pulverised coal and combustive gas is therefore stopped to prevent the tuyere stock and bustle pipe from filling up with pulverised coal.

A change in the characteristics of the image from the tuyere can also be interpreted as an indication that the flame at the lance tip is no longer burning.

The means for monitoring an image from the tuyere, typically used for detecting a tuyere blockage, can be used to monitor the burning of a flame at the lance tip. It may be concluded that the flame at the lance tip is not burning if the image from the tuyere changes according to a predetermined scheme. It may be concluded that the flame at the lance tip is not burning if the image from the tuyere has sufficient similarity with a predetermined paragon image.

The image from the tuyere is preferably analysed by means of an image processing algorithm.

According to a fourth embodiment of the invention, the method comprises:

providing the tuyere stock with a substantially horizontal blow pipe for blowing hot blast air into the furnace hearth of the blast furnace;

providing temperature measurement means, such as e.g. a pyrometer, arranged in axial alignment with the blow pipe; and monitoring a temperature in or near the tuyere and, based thereon, determine whether or not the flame at the tip of the pulverised coal injection lance is burning.

A pyrometer can e.g. be associated with each tuyere and measure the temperature of the flame in the furnace in front of the tuyere. The temperature signal allows monitoring the burning of a flame at the lance tip. It may be concluded that the flame at the lance tip is not burning if the temperature drops by a predetermined amount or if the temperature remains below a predetermined threshold for a predetermined amount of time.

The combustive gas used in connection with such pulverised coal injection lances is preferably oxygen.

BRIEF DESCRIPTION OF THE FIGURES

The present invention will be more apparent from the following description of one not limiting embodiment with reference to the attached drawing, wherein FIG. 1 shows a cut through an installation used for carrying out the method according to the present invention.

DETAILED DESCRIPTION

FIG. 1 shows a hot blast system 10 having a bustle pipe 12 encircling a blast furnace and a plurality of tuyere stocks 14 for feeding hot blast air through an opening in the blast furnace wall 16 into the furnace hearth of the blast furnace. The tuyere stocks 14 are refractory-lined steel tubes for supplying the hot blast air from the bustle pipe 12 to the blast furnace. They each generally comprise an angled first portion 14', also referred to as downcomer, and a substantially horizontal second portion 14", also referred to as blow pipe. The second portion 14" has a convex spherical nose, designed and arranged so as to come into airtight engagement with a concave end of a tuyere 15 installed in the opening in the furnace wall 16. The first portion 14' is arranged at an angle with respect to the horizontal portion 14" and is connected to the bustle pipe 12 for leading the hot blast air from the bustle pipe 12 to the second portion 14".

A pulverised coal injection lance 18 is provided for injecting pulverised coal into the blast furnace. The lance 18 is of the oxycoal type and comprises an inner pipe 20 for conveying pulverised coal and an outer pipe 22, coaxially arranged around the inner pipe 20, for conveying combustive gas. The inner pipe 20 forms a separation wall for separating the pulverised coal from the combustive gas all the way through the lance 18, until the pulverised coal and the combustive gas are allowed to mix at a lance tip 24 of the pulverised coal injection lance 18.

The pulverised coal injection lance 18 is arranged in such a way that its lance tip 24 is situated in an exit region 26 of the tuyere 15, near the opening in the furnace wall 16.

In operation, hot blast is blown from the bustle pipe 12, through the tuyere stock 14 into the furnace hearth of the blast furnace. Additionally, pulverised coal and combustive gas, typically oxygen, is fed through the pulverised coal injection lance 18 into the second portion 14" of the tuyere stock 14. At the lance tip 24, the pulverised coal comes into contact with the oxygen and forms a mixture. The combustion conditions are such that this mixture ignites and a flame burns at the lance tip 24 inside the tuyere 15. The pulverised coal is burnt preferably completely inside the tuyere 15.

As the flame at the lance tip 24 is not stable and does sporadically go out, it is necessary to get the flame to reignite. The reignition of the flame is achieved by temporarily reducing the amount of oxygen fed through the lance 18. This alters the combustion conditions and the flame reignites when the oxygen supply is restored. The temporary reduction of the flow of combustive gas may cause heating and/or turbulences at the lance tip 24, which encourages reignition of the flame.

The determination of whether or not the flame at the lance tip 24 is burning is, according to the present invention, based on systems currently used for determining a blockage of the tuyere 15. Such systems are already installed on blast furnace installations and do therefore not incur any additional costs.

Such blockage detection systems may e.g. include means for measuring a pressure drop in the hot blast air across the first portion 14' of the tuyere stock 14. to this effect, the first portion 14' may comprise a Venturi type cross-section reduction 28.

Such blockage detection systems may alternatively or additionally include detection means 30 arranged in axial alignment with the second portion 14" of the tuyere stock 14. In the bend 32 joining the first and second portions 14', 14" of the tuyere stock 14, the latter can comprise an axial extension pipe 34 at the end of which the detection means 30 may be arranged.

The detection means 30 can be a light intensity detector for measuring light intensity in the tuyere 15. A reduction in light intensity can be interpreted as an indication that the flame at the lance tip 24 is no longer burning.

The detection means 30 can be a camera for monitoring an image from the tuyere 15. The captured image can be analysed by an image processor. Changes in some characteristics of the image from the tuyere 15 can also be interpreted as an indication that the flame at the lance tip 24 is no longer burning.

The invention claimed is:

1. A method for feeding pulverised coal into a blast furnace; comprising:

providing a tuyere stock for blowing hot blast air from a bustle pipe into a furnace hearth of a blast furnace through a tuyere installed in an opening in a furnace wall;

providing a pulverised coal injection lance for feeding pulverised coal into the tuyere, the pulverised coal injection lance comprising an inner pipe for conveying pulverised coal and an outer pipe, coaxially arranged around the inner pipe, for conveying combustive gas, the inner pipe forming a separation wall for separating the pulverised coal from the combustive gas, the pulverised coal injection lance having a lance tip arranged in the tuyere;

allowing the pulverised coal and the combustive gas to form a mixture of pulverised coal and combustive gas at the lance tip; and burning the mixture of pulverised coal and combustive gas in the tuyere;

monitoring whether or not a flame at the lance tip is burning; and upon determination that a flame at the lance tip is not burning, reigniting a flame by temporarily reducing a flow of combustive gas through the pulverised coal injection lance, wherein, while the flow of combustive gas through the pulverised coal injection lance is temporarily reduced, a flow of pulverised coal through the pulverised coal injection lance is maintained.

2. The method according to claim 1, wherein the monitoring the burning of a flame at the lance tip is carried out continuously.

3. The method according to claim 1, wherein the monitoring the burning of a flame at the lance tip is carried out by tuyere blockage detection means.

4. The method according to claim 1, comprising:

providing tuyere blockage detection means with pressure sensors for measuring a pressure drop in the hot blast air across a section of tuyere stock upstream of the lance tip; and monitoring the pressure drop across the section of tuyere stock and, based thereon, determine whether or not a flame at the lance tip is burning.

5. The method according to claim 4, wherein the pressure drop is measured between the bustle pipe and a section of tuyere stock upstream of the lance tip.

6. The method according to claim 4, wherein it is concluded that a flame at the lance tip is not burning if the pressure drop is increased by a predetermined amount.

7. The method according to claim 6, wherein it is concluded that a flame at the lance tip is not burning if the pressure drop is increased by a for a predetermined amount of time.

8. The method according to claim 1, comprising:

providing the tuyere stock with a substantially horizontal blow pipe for blowing hot blast air into the furnace hearth of the blast furnace;

providing tuyere blockage detection means with a light intensity detector arranged in axial alignment with the blow pipe; and monitoring a light intensity in the tuyere and, based thereon, determine whether or not a flame at the lance tip is burning.

9. Method according to claim 8, wherein it is concluded that the flame at the lance tip is not burning if the light intensity in the tuyere is reduced by a predetermined amount.

10. The method according to claim 9, wherein it is concluded that a flame at the lance tip is not burning if the light intensity in the tuyere is reduced by for a predetermined amount of time.

11. The method according to claim 1, comprising:

providing the tuyere stock with a substantially horizontal blow pipe for blowing hot blast air into the furnace hearth of the blast furnace;

providing tuyere blockage detection means with a camera arranged in axial alignment with the blow pipe; and monitoring an image in the tuyere and, based thereon, determine whether or not a flame at the tip of the pulverised coal injection lance is burning.

12. The method according to claim 11, wherein it is concluded that a flame at the lance tip is not burning if the image from the tuyere changes according to a predetermined scheme.

13. The method according to claim 11, wherein the image from the tuyere is analysed by means of an image processing algorithm.

14. The method according to claim 1, comprising:

providing the tuyere stock with a substantially horizontal blow pipe for blowing hot blast air into the furnace hearth of the blast furnace;

providing temperature measurement means arranged in axial alignment with the blow pipe; and monitoring a temperature in or near the tuyere and, based thereon, determine whether or not a flame at the tip of the pulverised coal injection lance is burning.

* * * * *